US006415633B2

(12) United States Patent
Schmid et al.

(10) Patent No.: US 6,415,633 B2
(45) Date of Patent: Jul. 9, 2002

(54) FLAT KNITTING MACHINE

(75) Inventors: Franz Schmid, Bodelshausen; Hans-Guenther Haltenhof, Pfullingen; Stefan Mayer, Reutlingen, all of (DE)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 09/880,165

(22) Filed: Jun. 12, 2001

(30) Foreign Application Priority Data

Jun. 29, 2000 (DE) ..... 100 31 684

(51) Int. Cl.[7] ..... D04B 7/04
(52) U.S. Cl. ..... 66/64; 66/114
(58) Field of Search ..... 66/60 R, 64, 114, 66/104, 106, 107, 110

(56) References Cited

U.S. PATENT DOCUMENTS 5,305,620 A * 4/1994 Yabuta ..... 66/64
5,475,991 A * 12/1995 Yabuta et al. ..... 66/64
5,918,483 A * 7/1999 Schmid et al. ..... 66/64
6,079,233 A * 6/2000 Shima ..... 66/106

FOREIGN PATENT DOCUMENTS

| | | |
|---|---|---|
| DE | 569 752 | 2/1933 |
| DE | 1 872 478 | 5/1963 |
| EP | 0 533 414 A1 | 3/1993 |
| EP | 0 897 027 A2 | 2/1999 |

* cited by examiner

*Primary Examiner*—Danny Worrell
(74) *Attorney, Agent, or Firm*—Michael J. Striker

(57) ABSTRACT

A flat knitting machine has at least two oppositely located needle beds provided with stitch formers and/or comb gap plates, one of the needle beds having a wire which forms a knocking off base for stitches, so that for changing a comb gap width of the stitch formers and/or of the comb gap plates they are arranged jointly adjustable on the at least one needle bed.

9 Claims, 6 Drawing Sheets

FLAT KNITTING MACHINE

BACKGROUND OF THE INVENTION

The present invention relates to a flat knitting machine with at least two oppositely located needle beds with stitch formers and/or cam gap plates.

Flat knitting machines as a rule nowadays fixed comb gap widths, which represent a compromise between the desire to provide a maximum possible comb gap width for wear-free formation of the stitches and the desire to provide a minimum comb gap width to maintain the shortest possible thread length from the stitch head of the needle of the front needle bed to the stitch head of the needle of the rear needle bed.

It is however known that in many knitting articles, in particular double-face knitted articles the stitch formation can be optimized when the comb gap width is changed in correspondence with the used yarn thickness. A method has been proposed, in which the comb gap width can be changed by displacing the needle beds parallel to their longitudinal axes. This comb gap width is then maintained until the machine is converted to the production of a different knitted article. Such a method is disclosed for example in the German patent document DE GM 1 827 478. The comb gap width can be adjusted within certain steps. The German patent document DE PS 569 752 discloses a method in which a stepless displacement of the needle beds and thereby a stepless adjustment of the comb gap width is possible. These known methods, in which a displacement of the total needle bed is required are however performed only manually and not during the knitting process.

The European patent document EP OS 0 533 414 discloses a flat knitting machine, in which the knocking over base of the needle bed is formed by plates. These plates can be reciprocatingly displacable over controlled cams located on a cam plate of the carriage, toward the machine longitudinal axis or from it. Thereby no change of the comb gap width is produced, but this method provides with double-face knitting products, a similar effect as the change of the comb gap width.

In the flat knitting machine disclosed in the European patent document EP OS 0 897 027, the stitch former performs a turning movement to the machine longitudinal axis or from it. Here also the movement of the stitch former is performed via a control cap which is located on the lock plate. A rear change of the comb gap width does not take place here, but with this method the quality of the single-face knitted product can be improved, and its at most each second needle of a needle bed forms stitches.

The action of plates or stitch formers via control cams which are arranged on the carriage leads in the known methods to the fact that the knocking over base is located in an exactly defined distance to the machine longitudinal axis only as the plates are in engagement with the control cam. During the remaining time of the carriage movement they however assume different positions which negatively act on the uniformity of the stitch formation. A further disadvantage of the control of the machine formers and plates via control cams of the lock plate is that, the control cams of the lock plates expand in direction toward the machine longitudinal axis and thereby the engagement region to the elements which form the stitches is reduced for the operator of the machine.

SUMMARY OF THE INVENTION

Accordingly, it is an object of the present invention to provide a flat knitting machine, which eliminates the disadvantages of the prior art.

More particularly, it is an object of the present invention to provide a flat knitting machine in which for increase of the quality of the stitch formation, in particular the comb gap width, it is adjustable during the knitting process without moving the needle beds.

In keeping with these objects and with others which will become apparent hereinafter, one feature of the present invention resides, briefly stated, in a flat knitting machine with at least two oppositely located needle beds with stitch formers and/or comb gap plates, in which for changing the comb gap width the stitch formers and/or the comb gap plates of at least one needle bed, in which a wire which forms the knocking off base for the machine is fitted are jointly displaceble on the needle bed.

In the inventive flat knitting machine, an adjustment of the comb gap width is possible over the whole length of the needle bed, without moving the needle beds themselves. The adjusted comb gap width remains until a needle adjustment is needed. Therefore the adjustment of the stitch formers and/or comb gap plate is performed during knitting process. The adjustment of the stitch formers and/or comb gap plates can be performed independently from the position of the carriage. Therefore the carriage position and speed must not be changed for adjusting of the comb gap width.

In accordance with a preferable embodiment of the inventive flat knitting machine, the wire which forms the knocking off base for stitches is fixed in each second machine former of a needle bed, and the intermediate stitch formers are arranged so that they are jointly adjustable to the stitch formers which serve for fixing the wires. The stitch formers which do not serve for fixing the knocking off wire can assume a different position than the stitch formers for fixing the knocking off wire and thereby also another position relative to the knocking off base than the others.

When the flat knitting machine is designed with more possibilities to influence the comb gap, the knocking off base for the wire which forms the stitches can be fixed in the comb gap plate, and the comb gap plate can be arranged adjustably in the needle bed together and independently from the jointly adjustable stitch formers. Therefore three types of the stitch formers can be provided, which are arranged independently from one another and adjustably on the needle beds. Thereby the independently adjustable elements are formed: the comb gap plates, and the stitch formers of the first and second types.

Preferably the stitch formers and/or the comb gap plates are arranged adjustably so that, they are guided in each adjustment position so that in different positions of the stitch formers and the comb gap plate are excluded, which is disadvantageous for the uniformity of the stitch forming.

For driving, the stitch formers and/or the comb gap plates can be supported on strips which are displaceable longitudinally and/or transversely to the needle bed longitudinal direction. The strips can be provided with at least two longitudinal openings which are inclined to the needle bed longitudinal axis, and guiding pins which are mounted on needle beds can extend through the longitudinal openings. By supporting the stitch formers and/or comb gap plates on the strips, the displacement of the strips which is guided by the guiding pins can perform a movement of the stitch formers and/or comb gap plates to the machine longitudinal axis and from it. Correspondingly the comb gap increases or reduces.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accombanying drawings.

DESCRIPTION OF THE PREFERRED EMBODIMENTS

Figure 1:
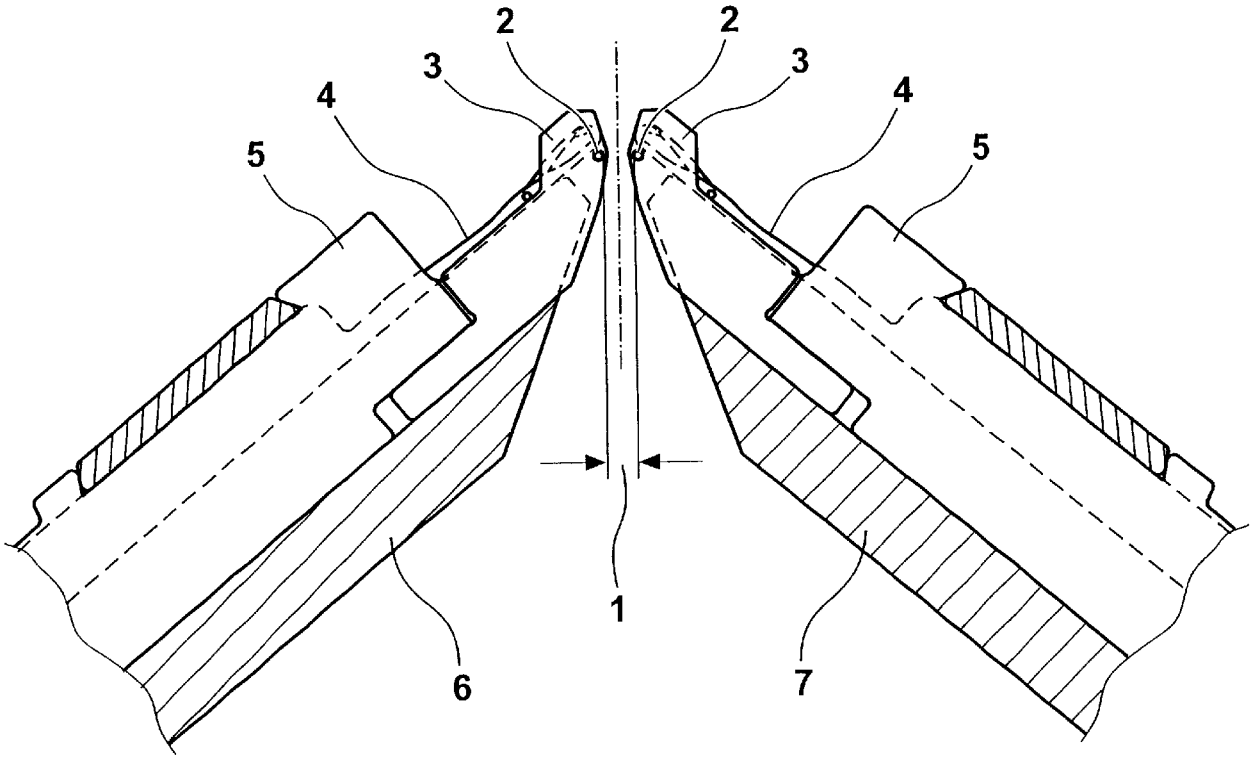
FIG. 1 is a view showing a transverse section of a front and a rear needle bed of a flat knitting machine in accordance with the prior art.

FIG. 1 shows a cross-section of a front needle bed 6 and a rear needle bed 7 of a knitting machine in accordance with the prior art with a not changeable comb gap width 1. The needle beds 6 and 7 have stitch formers 3 and needle bed webs 5. The knocking off base is formed by wires 2 which are fixed by each stitch former 3. The stitch formers 3 are arranged fixedly on the needle beds 6 and 7. The needles 4 are located in their basic position. An adjustment of the comb gap width is not possible in this knitting machine.

Figure 2A:
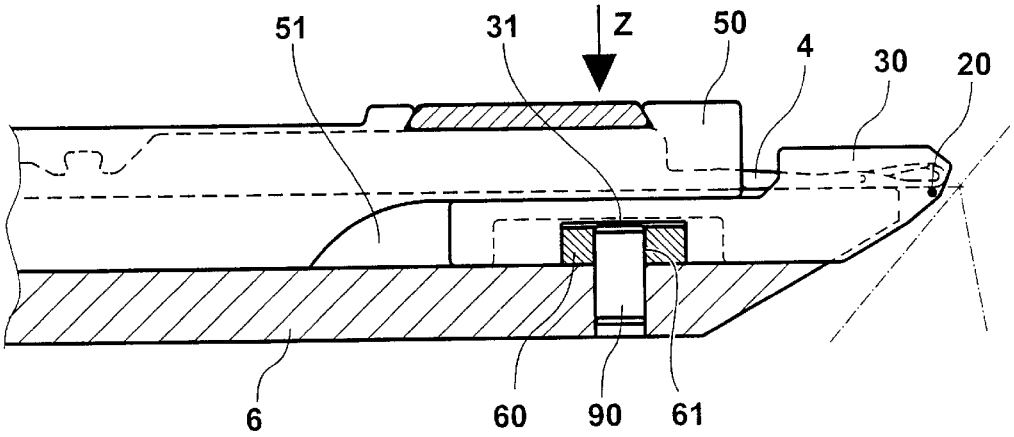
FIG. 2*a* is a view showing a cross-section of a front needle bed of a first embodiment of an inventive flat knitting machine.

Contrary to this, FIG. 2*a* shows a cross-section of a needle bed 6 in accordance with a first embodiment of the inventive knitting machine, with an adjustable comb gap width. The stitch formers 30, which all serve for fixing a wire 20 forming the knocking off base, are arranged in group 51 of the needle bed webs 50 so as to be longitudinally movable. They have moreover a guiding groove 31 which engages a strip 60 in a formlocking manner so that the stitch formers 30 can slide on the strips 60. The strip 60 has a groove, in which a guiding pin fixedly connected with the needle bed 6 forms a sliding guide.

FIG. 26 shows the different possible positions of the stitch former 30. KS 0 identifies a medium comb gap width. When the stitch formers are pre-driven from this position located in the middle, the minimal comb gap width KS− is produced. In their maximum withdrawn position the stitch former 30 provide a maximum comb gap width KS+.

Figure 2B:
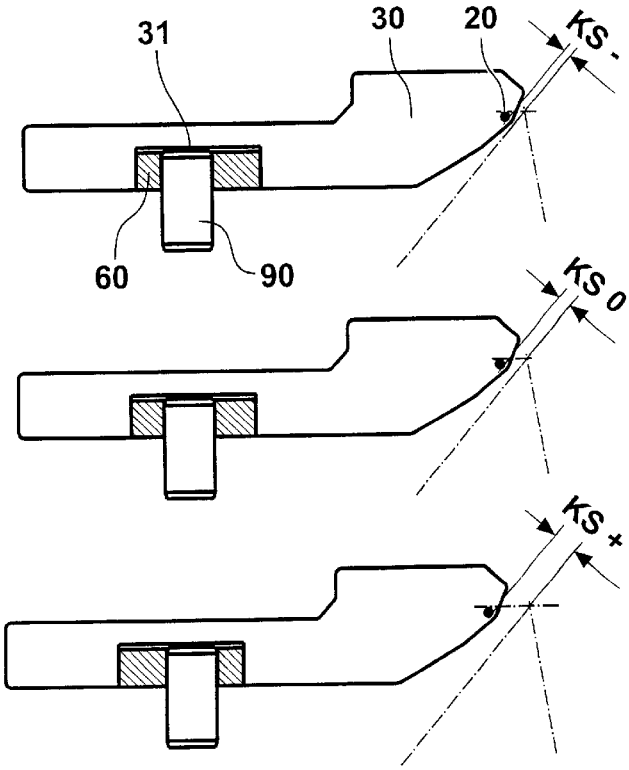
FIG. 2*b* is a view showing a stitch former of the needle bed of FIG. 2*a* in displaced adjustment position.
Figure 2C:
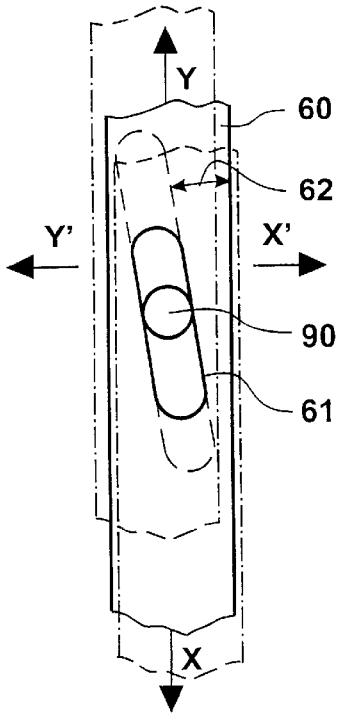
FIG. 2*c* is a partial view of a device for adjusting the stitch formers of the needle bed of FIG. 2*a;*

FIG. 2*c* shows the strip 60 for adjusting the stitch former 30 on a plan view. It can be recognized that the groove 61 has the shape of a longitudinal hole in which the guiding pin 90 can slide. By moving the strip 60 in direction of the arrow Y or arrow X, the strip 60 is moved either in direction of Y' or X'. Thereby this leads to a movement of the stitch former 30 located on the strip 60, toward the machine longitudinal axis or away from it. Correspondingly, the comb gap width changes.

Figure 3A:
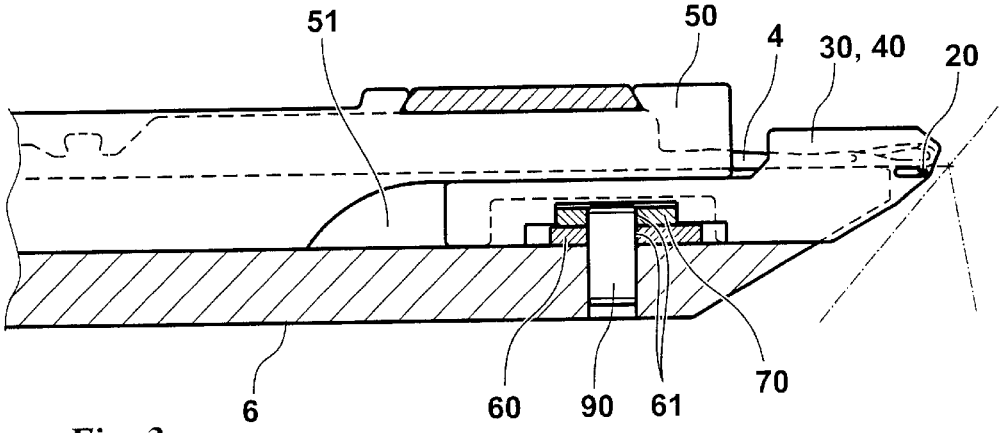
FIG. 3*a*is a view showing a cross-section through the front needle bed of a second embodiment of the inventive flat knitting machine.
Figure 3B:
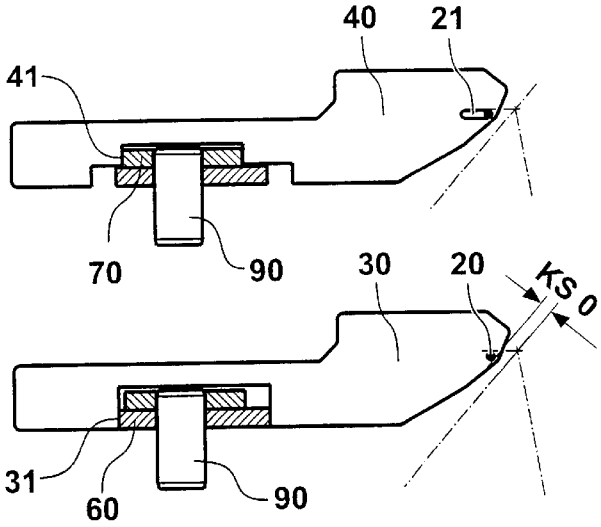
FIG. 3*b* is a detailed view of two stitch formers of the needle bed of FIG. 3*a;*
Figure 3C:
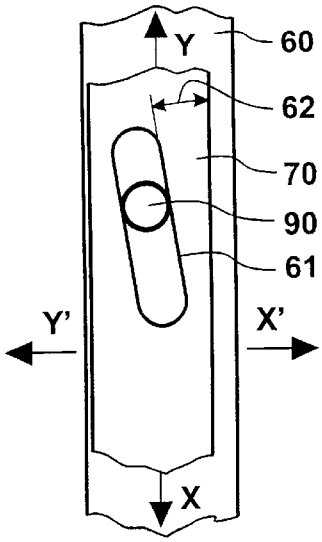
FIG. 3*c* is a partial view of an adjusting device for adjusting the stitch formers of FIG. 3*b;*

FIGS. 3*a*–3*c* show the positions of a second embodiment of a needle bed 6 of the inventive flat knitting machine, corresponding to FIGS. 2*a*–2*c*. Contrary to the needle bed 6 of FIG. 2*a,* here two different stitch formers 30 and 40 are provided. The stitch former 30 serves for fixing of the knocking off wire 20, while the stitch former 40 has a longitudinal openings 21 through which the knocking off wire 20 can pass as shown in FIG. 3*b*. The stitch formers 30 and 40 can be adjusted independently from one another. For this purpose two strips 60 and 70 are provided with the stitch 60 the stitch former 30 which fixes the knocking off wire 20 is displaced, while with the strip 70 the stitch former 40 is adjusted. Since the strip 40 has a smaller width than the strip 60, a continuous adjustment of the stitch formers 30 and 40 independently from one another is guaranteed. The comb gap width is determined exclusively by the stitch former 30 and its position. The strips 60 and 70 have aligned grooves 61, through which the guiding pin 90 fixedly connected with the needle bed 6 is extended as shown in FIG. 3*c*.

Figure 4A:
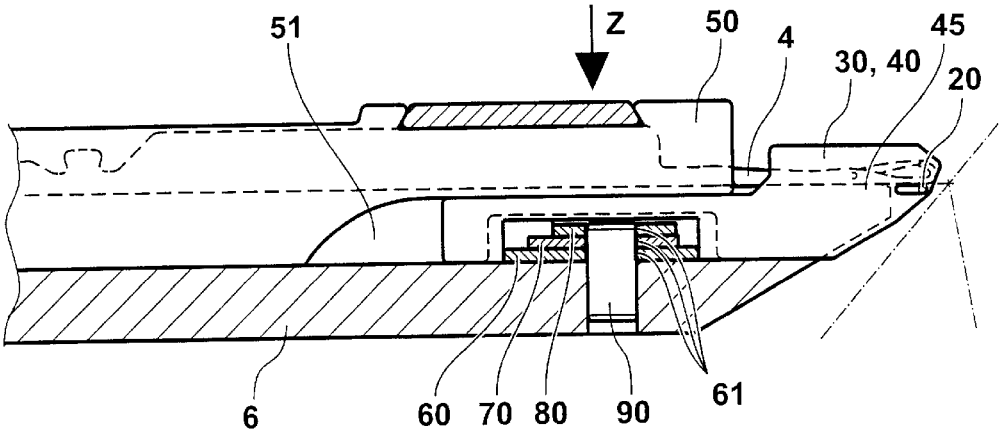
FIG. 4*a* is a view showing a cross-section of the front needle bed of a third embodiment of an inventive flat knitting machine.
Figure 4B:
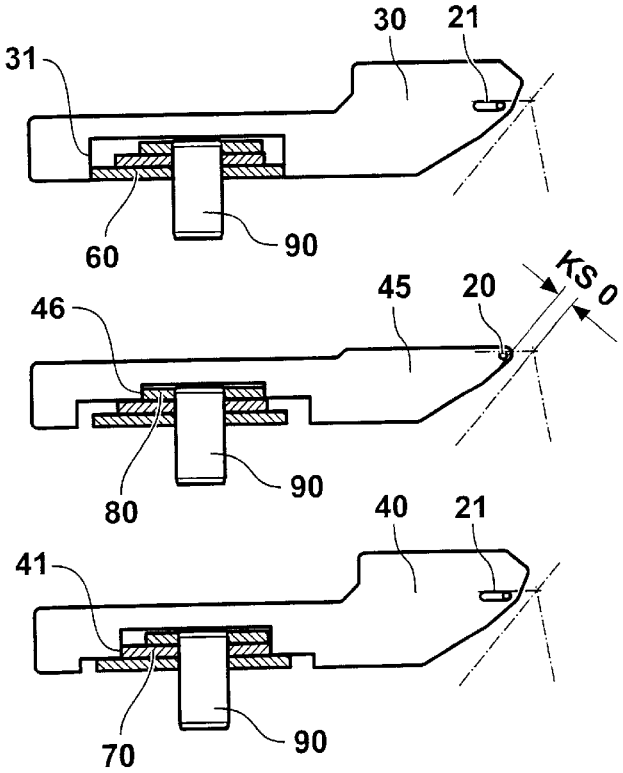
FIG. 4*b* is a detailed view of two stitch formers and a comb gap plate of the needle bed in FIG. 4*a;*
Figure 4C:
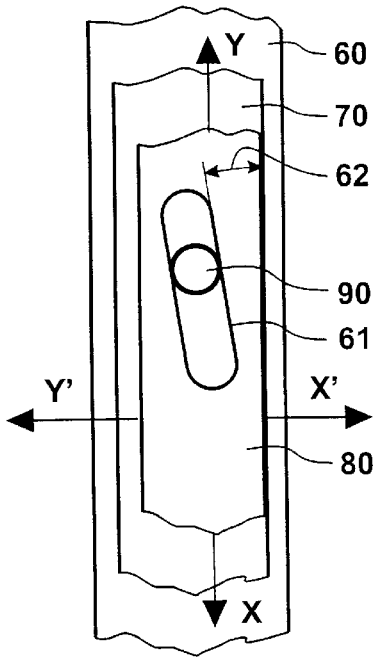
FIG. 4*c* is a partial view of an adjusting device for a stitch formers and the comb gap plate of the needle bed in FIG. 4*a;*

FIGS. 4*a*–4*c* are views of a third embodiment of an inventive flat knitting machine, similar to FIGS. 3*a*–3*c*. This embodiment provides many adjustment possibilities. The knocking off wire 20 is here fixed by comb gap plates 45. Moreover, two stitch former types 30 and 40 are provided, each having longitudinal openings 21 through which the knocking off wire 20 is guided. Since here three different elements are provided which must be adjusted jointly but independently from one another, three guiding strips are here provided. They are arranged over one another and have a width which reduces from below upwardly. The guiding strip 60 serves for controlling the movement of the stitch former 30, the guiding strip 70 serves for adjusting the stitch former 40, and the guiding strip 80 serves for adjusting comb gap plates 45. The comb plate width is influenced only by the change of the position of the comb gap plates 45. The stitch formers 30 and 40 can move however when required independently from the comb gap plate 45. It must be here guaranteed that their position does not collide with the knocking off wire 20.

Figure 5A:
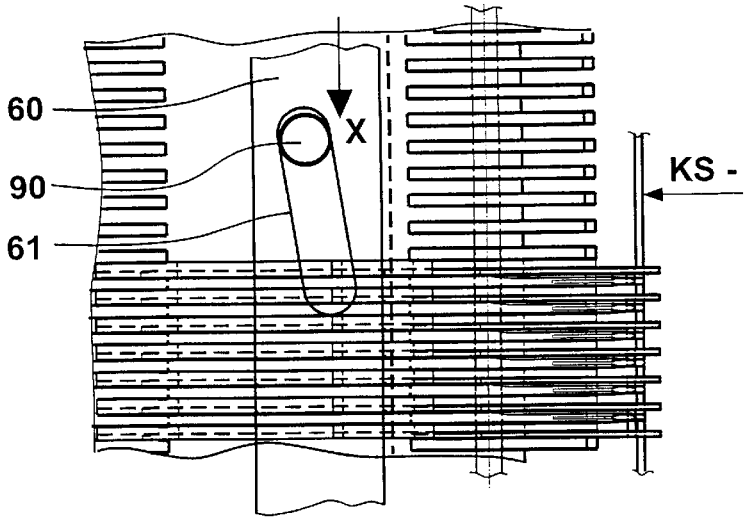
FIGS. 5*a*–5*c* are schematic detailed views of the front needle bed of FIG. 2*a* in direction of the arrow Z in different positions of the stitch formers.
Figure 5B:
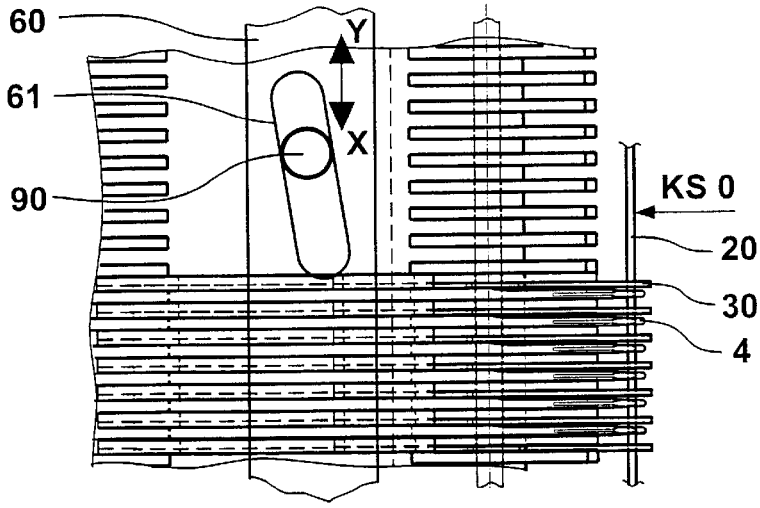
Figure 5C:
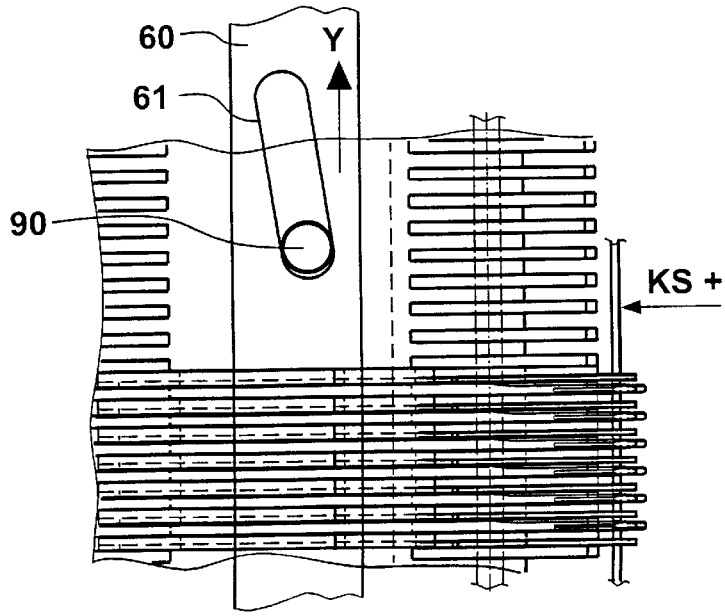

FIGS. 5*a*–5*c* show a portion of the needle bed 6 of FIG. 2*a* in direction of the arrow Z. FIG. 5*a* shows the position of the strip 60 in the end position which is possible in direction of the arrow X. The guiding pin hits the end of the longitudinal opening 61. All stitch formers extend in their outermost positions, whereby a minimum comb gap width KS− is produced. FIG. 5*b* shows a medium position of the stitch former 30 which leads to a medium comb gap width KS 0. FIG. 5*c* finally shows the end position of the strip 60 during the displacement in Y direction. In this position the stitch former 30 and thereby the knocking off wire 20 assume their innermost position, so that a maximum comb gap width KC+ is produced.

Figure 6:
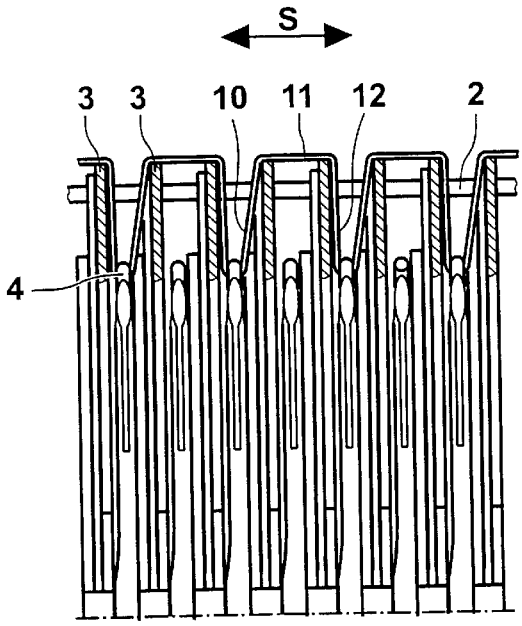
FIG. 6 is a schematic view of a thread course of a one-layer knitted product which is produced by each second needle of a needle bed, on a flat knitting machine which rigid stitch formers.

FIGS. 6 and 7 demonstrate the advantages of the stitch formers 30 and 40 which are adjustable independently from one another in accordance with the embodiment of the inventive flat knitting machine shown in FIGS. 4*a* –4*c*, when compared with a flat knitting machine with rigid stitch formers. FIG. 6 shows a detail view of a needle bed with rigid stitch formers 3 during knitting of a one-face knitted product with only each second needle 4. The thread quantity which is located between two knitting needle hooks 4 is put together from the strands 10, 11 and 12.

Figure 7A:
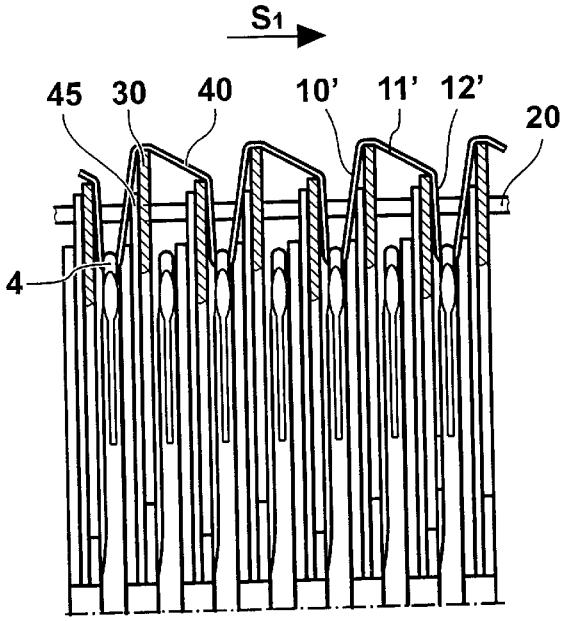
FIGS. 7*a,* 7*b* are schematic views of a thread course corresponding to FIG. 6 of a flat knitting machine with a needle bed corresponding to FIG. 4*a.*
Figure 7B:
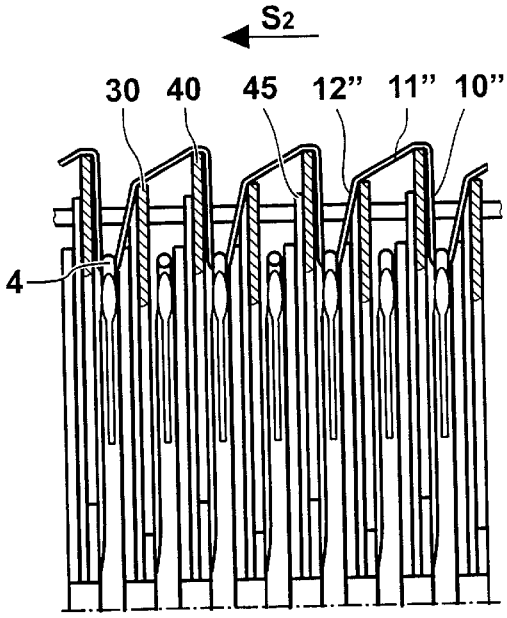

In contrast FIGS. 7*a* and 7*b* show a detailed view of a needle bed of FIGS. 4*a* with stitch formers 30 and 40 which are adjustable independently from one another. The stitch former 30 is extended in the knitting direction S1 as far as the stitch former 40. In the reverse knitting direction S2 to the contrary, the stitch former 30 is extended farther than the stitch former 30. The position of the knocking off wire 20 is determined by the comb gap plate 45. The thread quantity which extends here between two neighboring stitches is put together in FIG. 7*a* from the strands 10', 11' and 12' and in FIG. 7*b* from the strands 10", 11" and 12". As a whole, this thread length is shorter than the thread length between two stitches in a needle bed of FIG. 6. This leads to an improved structure of a knitted product.

It will be understood that each of the elements described above, or two or more together, may also find a useful application in other types of constructions differing from the types described above.

While the invention has been illustrated and described as embodied in flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A flat knitting machine, comprising at least two oppositely located needle beds provided with stitch formers and/or comb gap plates, one of said needle beds having a wire which forms a knocking off base for stitches, and for changing a comb gap width of said stitch formers and/or of said comb gap plates they are arranged jointly adjustable on said at least one needle bed.

2. A flat knitting machine as defined in claim 1; and further comprising means for adjustment of said stitch formers and/or said comb gap plates during a knitting process.

3. A flat knitting machine as defined in claim 1, wherein said stitch formers and/or comb gap plate are arranged so that an adjustment of said stitch formers and/or said comb gap plate is performable independently from a position of a carriage.

4. A flat knitting machine as defined in claim 1, wherein said wire which forms said knocking off base for stitches is fixed in each second stitch former of said at least one needle bed, and intermediate stitch formers are jointly adjustable in said at least one needle bed independently from said stitch formers serving for fixing of said wire.

5. A flat knitting machine as defined in claim 4, wherein said knocking off base for said wire which forms stitches is fixed in said comb gap plates, and said comb gap plates being arranged so that they are adjustable in said at least one needle bed jointly and independently from the jointly adjustable stitch formers.

6. A flat knitting machine as defined in claim 5, wherein said stitch formers are provided in two types which are adjustable independently from one another on said at least one needle bed.

7. A flat knitting machine as defined in claim 1; and further comprising means for adjusting said stitch formers and/or said comb gap plates so that they are guided in each adjusting position.

8. A flat knitting machine as defined in claim 1; and further comprising strips on which said stitch formers and/or comb gap plates are supported and which are adjustable in a direction selected from the group consisting of a direction longitudinally of a needle bed longitudinal direction, transversely to the needle bed longitudinal direction, and both.

9. A flat knitting machine as defined in claim 8, wherein said strips are provided with at least two longitudinal openings which extend inclinedly to a needle bed longitudinal axis; and further combrising guiding pins which are mounted on said at least one needle bed and extend through said longitudinal openings.

* * * * *